US006802374B2

(12) United States Patent
Edgar et al.

(10) Patent No.: US 6,802,374 B2
(45) Date of Patent: Oct. 12, 2004

(54) REVERSE CEMENTING FLOAT SHOE

(75) Inventors: Mike Edgar, Bakersfield, CA (US); Greg Horton, Bakersfield, CA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/283,507

(22) Filed: Oct. 30, 2002

(65) Prior Publication Data

US 2004/0084182 A1 May 6, 2004

(51) Int. Cl.[7] ..... E21B 33/14
(52) U.S. Cl. ..... 166/285; 166/242.8; 166/328
(58) Field of Search ..... 166/177.4, 242.8, 166/285, 291, 318, 327, 328, 323, 325

(56) References Cited

U.S. PATENT DOCUMENTS 5,641,021 A * 6/1997 Murray et al. ..... 166/291
6,390,200 B1 * 5/2002 Allamon et al. ..... 166/376

* cited by examiner

*Primary Examiner*—Zakiya Walker
(74) *Attorney, Agent, or Firm*—Stephen Schlather; Robin Nava

(57) ABSTRACT

A float shoe comprising an upper section having a casing connection at an upper end thereof, and a lower section slidably coupled to the upper section, the lower section comprising a closed lower end and having at least one port disposed therein.

20 Claims, 5 Drawing Sheets

REVERSE CEMENTING FLOAT SHOE

BACKGROUND OF INVENTION

After drilling a borehole in the earth, a "casing" is often placed in the borehole to facilitate the production of oil and gas. The casing is a pipe that extends down the borehole, through which the oil and gas will eventually be extracted. The region between the casing and the borehole itself is known as the annulus. The casing is usually "cemented" into place in the borehole.

In general, when drilling a wellbore, a drilling fluid is pumped down the drill string during drilling. Common uses for drilling fluids include: lubrication and cooling of drill bit cutting surfaces while drilling, transportation of "cuttings" (pieces of formation dislodged by the cutting action of the teeth on a drill bit) to the surface, controlling formation pressure to prevent blowouts, maintaining well stability, suspending solids in the well, minimizing fluid loss into and stabilizing the formation through which the well is being drilled, fracturing the formation in the vicinity of the well, and displacing the fluid within the well with another fluid.

One particularly significant function of the drilling fluid is to maintain the downhole hydrostatic pressure and to seal the borehole. It is desirable that the hydrostatic pressure of the drilling fluid exceed the formation pressure to prevent formation fluids from seeping into the borehole before the well is complete. In a downhole environment, drilling fluids often form what is known in the art as a "mud cake," which is a layer of drilling fluid particulate that forms on the borehole wall and seals the borehole from the formation. When drilling is completed, the borehole remains filled with the drilling fluid.

Traditional cementing is done by lowering the casing into the borehole and pumping a cement slurry down the casing. As the slurry reaches the bottom of the casing, it is pumped out of the casing and into the annulus between the casing and the borehole wall. As the cement slurry flows up the annulus, it displaces any drilling fluid in the borehole. The cementing process is complete when cement slurry reaches the surface, and the annulus is completely filled with the slurry. When the cement hardens, it provides support and sealing between the casing and the borehole wall.

Cementing the casing into place serves several purposes. The cement holds the casing in place and provides support for the borehole to prevent caving of the borehole wall. The cement also isolates the penetrated formations so that there is no cross-flow between formations.

FIG. 1 shows a prior art cementing method. A borehole 101 is drilled into an earth formation 102. When the drilling is complete, a casing string 103, with a float shoe 110, is lowered into the borehole 101. A cement slurry 106 is pumped down the casing 103, and the cement slurry 106 exits the casing 103 near the bottom of the well. The float shoe 110 includes a check valve 109 to prevent reverse flow of drilling fluid into the casing 103 while the casing 103 is being run into the borehole 101 and while the cement is setting.

As the cement slurry 106 is pumped into the annulus 104 between the casing 103 and the borehole wall 101, the slurry 106 displaces any drilling fluid 105 in the annulus 104. When the cement slurry 106 in the annulus 104 reaches the surface, the slurry is allowed to harden. The arrows in FIG. 1 show the direction of cement slurry and drilling fluid flow in the casing 106 and annulus 104.

There are several drawbacks to traditional cementing. When the cement is first pumped into the casing, it falls down the length of the casing. This "free falling" can cause problems, especially in larger size casings. Another problem is that pumping cement down the casing and back up the annulus requires a significant amount of time. As a result, a retarding agent must be added to the slurry so that the cement will not set before the operation is complete.

Another method for cementing a casing in a borehole is called "reverse cementing." Reverse cementing is a term of art used to describe a method where the cement slurry is pumped down the annulus and eventually into the casing. The cement slurry displaces any drilling fluid as it is pumped down the annulus. The drilling fluid is forced down the annulus, into the casing and then back up to the surface through the casing. Once slurry is pumped into the bottom of the casing, the reverse cementing process is complete.

A typical float shoe used in a reverse cementing process has an open bottom with a check valve to prevent flow into the casing as the casing is run into the borehole. The valve must then be adjusted to allow flow into the casing during the reverse cementing process and then sealed after the process is complete. Because of the changing requirements for the float shoe, the valve must be a complex device.

SUMMARY OF INVENTION

One aspect of the invention relates to a float shoe comprising an upper section having a casing connection at an upper end thereof, and a lower section slidably coupled to the upper section, the lower section comprising a closed lower end having at least one port disposed therein. In some embodiments, the float shoe according to this aspect of the invention includes a plurality of shear pins that, when intact, maintain the upper section and the lower section in an open position. In some other embodiments, the lower section includes a lock ring and the upper section comprises a tapered wicker, the lock ring and the tapered wicker arranged to retain the upper section and the lower section in a closed position.

Another aspect of the invention relates to a method for cementing a casing into a well comprising the steps of inserting a casing having a float shoe on a lower end thereof into a borehole, filling an annulus between a wall of the borehole and the casing with a cement slurry and applying a downward force to the casing sufficient to shear at least one shear member and move the upper and lower sections into a closed position.

Yet another aspect of the invention relates to a float shoe comprising a hollow body having a casing connection at an upper end thereof, a closed end at a bottom end thereof, at least one port disposed in a side thereof that enables flow into the hollow body and a sliding member disposed on an inside of the hollow body and positioned so that fluid can flow through the at least one port when the sliding member is in an open position and so that the at least one port is blocked or closed when the sliding member is in a closed position. The sliding member typically has an annular upper surface, a fluid flow path through the center of the annular upper surface and a closing member that allows flow upward through the fluid flow path and does not allow downward flow through fluid flow path. The closing member is typically positioned to transmit fluid pressure in the casing to a downward force on the sliding member. In some embodiments, the sliding member may be an annular member, and in some other embodiments the closing member may be a ball.

Still another aspect of the invention relates to a method for cementing a casing into a borehole comprising inserting the casing having a float shoe on a lower end thereof into the borehole, filling an annulus between a wall of the borehole and the casing with a cement slurry and pumping a drilling fluid down the casing thereby moving a sliding member disposed in the float shoe into a closed position.

Other aspects and advantages of the invention will be apparent from the following description and the appended claims.

DETAILED DESCRIPTION

Figure 1:
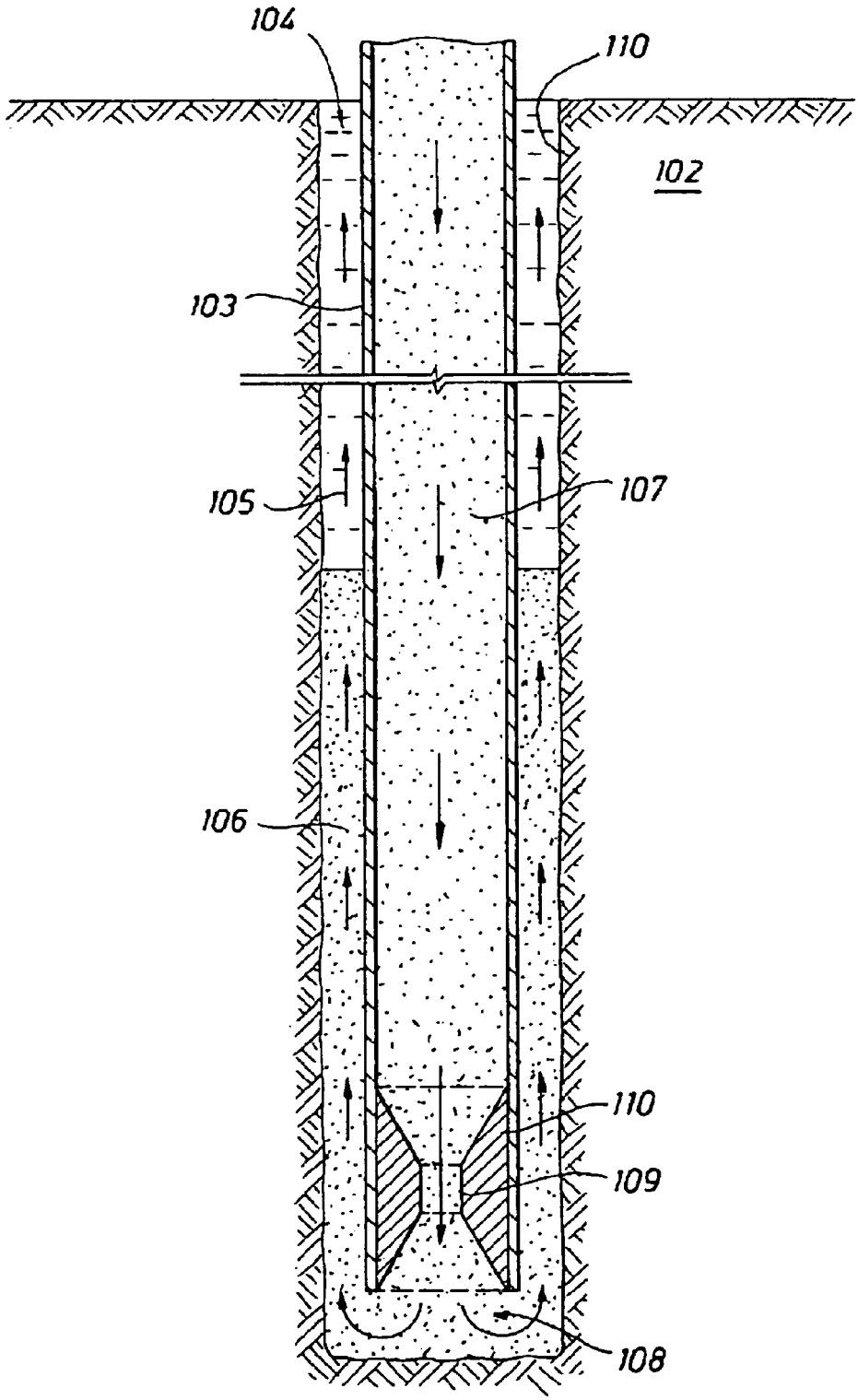
FIG.1 (PRIOR ART)
FIG. 1 shows a cross section of a prior art cementing apparatus.

This invention relates to reverse cementing float shoe apparatuses and methods for reverse cementing. In certain embodiments, a float shoe according to one aspect of the invention has an upper section and a lower section. The two sections may be slidably moved into a closed position when the reverse cementing process is completed. In certain other embodiments, a float shoe includes a piston that can be moved into a closed position by reversing the flow direction in the casing.

Exemplary embodiments of the invention will be described with reference to the accompanying drawings. Like items in the drawings are shown with the same reference numbers.

Figure 2:
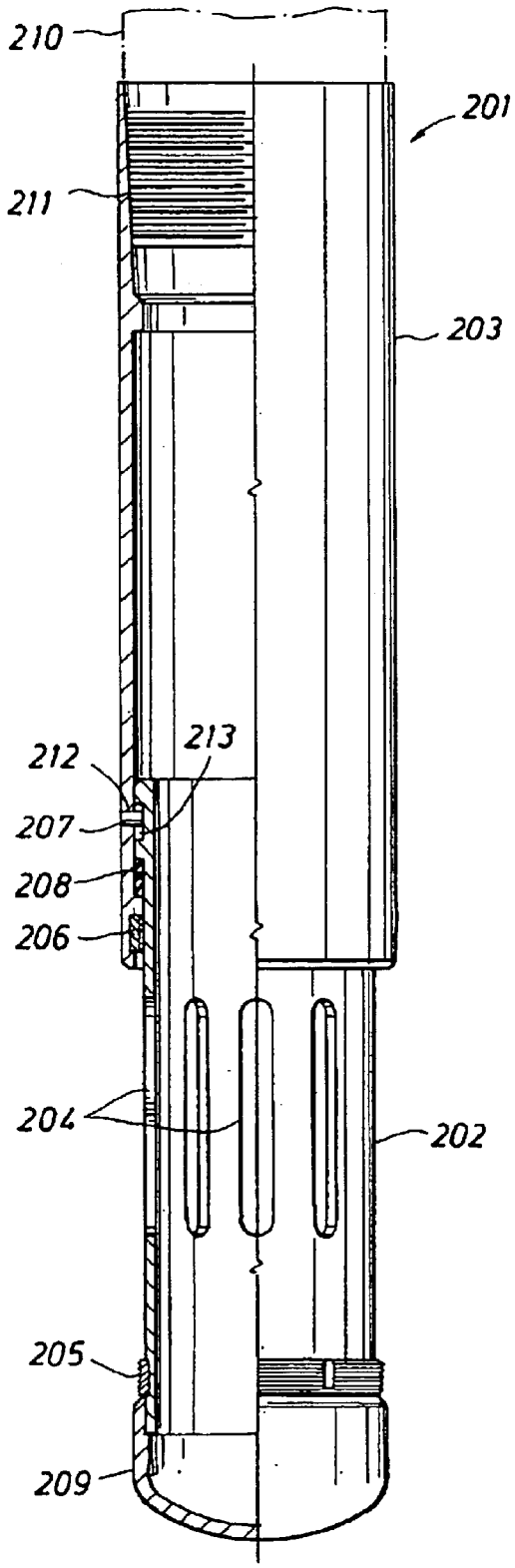
FIG. 2 shows a float shoe according to one aspect of the invention, with a cut-away cross section.

FIG. 2 shows one embodiment of a float shoe 201 according to one aspect of the invention. The float shoe 201 is connected to a casing 210 at a casing connection 211. In a preferred embodiment, the casing connection 211 is a threaded connection. The float shoe 201 comprises a lower section 202 and an upper section 203. The lower section 202 contains ports 204 disposed in the side of the lower section 202. In the open position, as is shown in FIG. 2, the ports 204 enable drilling fluid and cement slurry to enter the float shoe 201 and flow up into the casing 210. The ports may be of any suitable position, shape and configuration; however in a preferred embodiment, the ports 204 comprise six longitudinal slots in the side of the lower section 202.

The bottom of the lower section 202 may comprise a bull nose 209. The bull nose 209 is rounded to enable the casing 210 and the float shoe 201 to be run into the borehole without catching on the borehole wall. The bull nose 209 also enables the casing 210 to be reciprocated as it is run into the borehole to clean the borehole wall. Reciprocation is described further with reference to FIG. 3B. The bull nose may be constructed of a "drillable" material. A drillable material is a material that is easily penetrated or removed by a drill bit, in case the well needs to be deepened.

The left half of FIG. 2 is a cut-away cross section of a float shoe. The cut-away portion shows that the upper part of the lower section 202 may be disposed inside the upper section 203. When slidably coupled, the lower section 202 may slide inside the upper section 203, forming a float shoe 201 in a closed position, thereby sealing or obstructing the ports 204.

In some embodiments, the upper 203 and lower 202 sections comprise substantially cylindrical members. The upper section 203 has an inner diameter substantially the same as the outer diameter of the lower section 202. This arrangement enables the lower section 202 to fit inside the upper section 203, such that the upper section 203 forms a sleeve around the lower section 202. Although FIG. 2 shows the lower section 202 and the upper section 203 as cylindrical members, they are not required to be cylindrical. Further, those having ordinary skill in the art will realize that alternate arrangements are possible, without departing from the scope of this invention. For example, the lower section 202 could form a sleeve on the outside of the upper section 203. When closed, the upper section 203 would seal the ports from the inside of the lower section 202.

At least one shear member may be disposed in the float shoe 201 so as to retain the lower section 202 and the upper section 203 fixed in an open position. In some embodiments, and as shown in FIG. 2, the shear member comprises a shear pin 207 that is disposed in a shear port 212 in the upper member 203. The shear pin extends into a shear slot 213 in the lower member 202. Hereinafter, the shear member will be designated as a shear pin, as is shown in FIG. 2. Those having ordinary skill in the art will be able to devise other shear members without departing form the present invention.

The shear pin 207 is designed to shear when the downward force exceeds a specific value. That value may be selected so that the float shoe will remain in the open position while it is being run into the borehole. This requires that the shear pin 207 withstand the forces imposed on the float shoe during running. Once the reverse cementing process is complete, a downward force is applied to the casing that exceeds the shear stress of the shear pin 207. The shear pin 207 will shear, thereby allowing the float shoe to move to the closed position. A typical shear value is between 5,000 and 40,000 pounds of applied downward force.

In some embodiments, the float shoe 201 also contains a seal disposed between the upper section 203 and the lower section 202. The seal prevents fluids from flowing into or out of the float shoe 201 when the float shoe 201 is in the closed position. FIG. 2 shows an o-ring seal 208 disposed in the upper section, just below the shear member 207 and contacting the outer surface of the lower section 202.

The float shoe 201 may also include a means for locking the upper section 203 and the lower section 202 in a closed position. In one embodiment, a tapered wicker 206 may be disposed on the upper section 203 and a lock ring 205 may be disposed on the lower section 202. When the float shoe 201 is moved into the closed position, the tapered wicker 206 engages the lock ring 205 and retains the float shoe 201 in the closed position. The closed position will be described in more detail later, with reference to FIG. 3C.

Figure 3A:
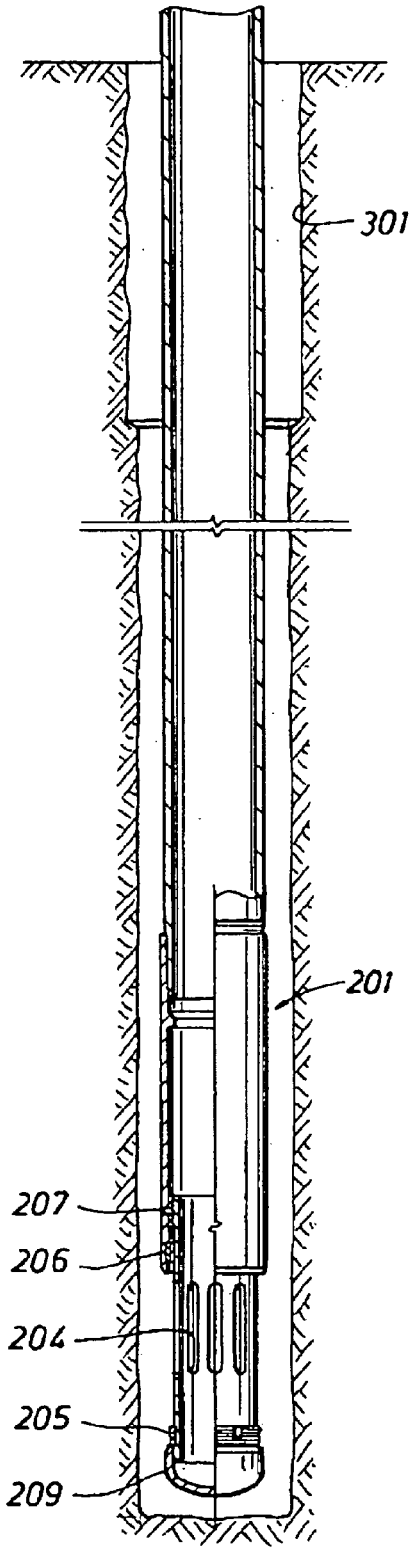
FIG. 3A shows a float shoe according to one aspect of the invention in an open position as it is being lowered into a borehole.

FIG. 3A shows an embodiment of a float shoe 201 in the open position as it travels down a borehole 301. The float shoe 201 is attached to a lower end of a casing 210 that is being lowered into the borehole 301. It is often the case that casing will be lowered into a borehole that is filled with drilling fluid. With the float shoe 201 in the open position, the drilling fluid in the borehole can flow through the ports 204, into the float shoe 201, and up into the casing 210 as the casing 210 is lowered into the borehole 301.

As the float shoe 201 travels down the borehole 301, it may be reciprocated in the borehole 301. As used herein, reciprocating the casing involves alternately raising and lowering the casing 210 in the borehole 301. Reciprocation is typically limited to 30 to 60 feet of vertical travel. Reciprocation is usually done to clean cuttings and other debris from the borehole 301 wall to ensure a good quality cementing (i.e., no void volumes are created by debris). When reciprocation is to be performed, the shear member 207 in the float shoe 201 should be designed to withstand the forces of reciprocation without shearing.

Figure 3B:
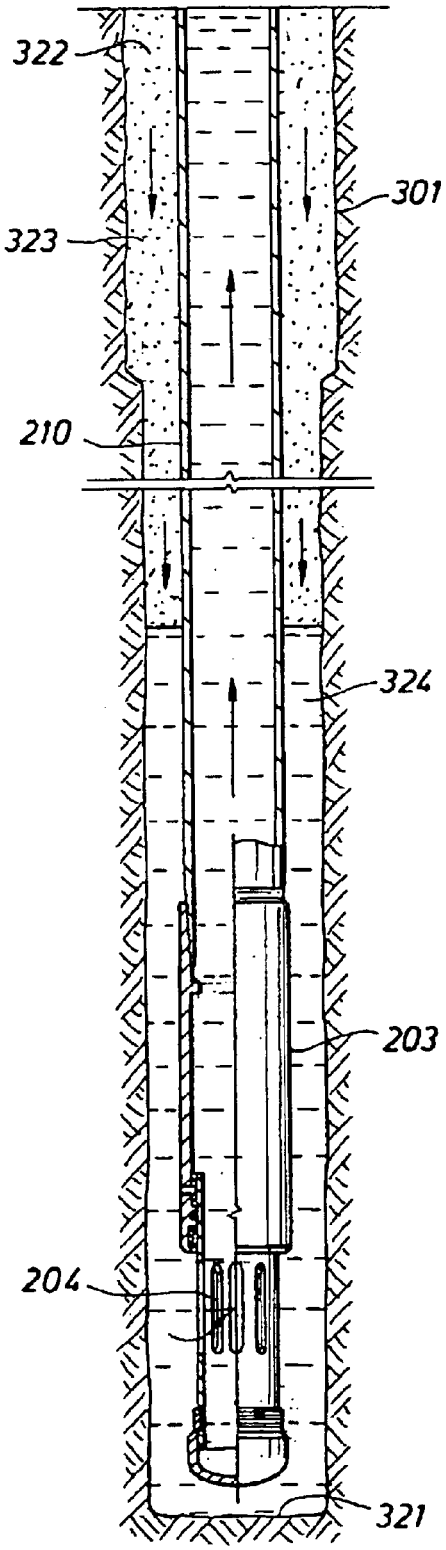
FIG. 3B shows a float shoe according to one aspect of the invention in an open position as a cement slurry is pumped into a casing.

FIG. 3B shows the casing 210 disposed in a borehole so that the float shoe 201 is positioned near the bottom 321 of the borehole 301. The float shoe 201 is in the open position. A cement slurry 323 is pumped into the annulus 322 between the borehole 301 and the casing 210. Any drilling fluid 324 in the annulus 322 is displaced by the cement slurry 323. The drilling fluid 324 is displaced down the annulus 322, into the float shoe 201 by way of the ports 204, and up the casing 210.

When the cement slurry 323 reaches the bottom 321 of the borehole 301, the cement slurry 323 flows into the float shoe through the ports 204. Typically, a small amount of slurry is pumped into the casing to ensure a complete cement job. The volume of cement slurry to be pumped into the annulus is determined by calculating the volume of the annulus and of the portion of the bottom of the casing to be filled with the cement slurry. That amount of cement slurry is pumped into the annulus. If the "returns," that is, the amount of drilling fluid that is forced out of the annulus, remains constant, then the cement must have displaced the drilling fluid and now occupies the annulus.

Figure 3C:
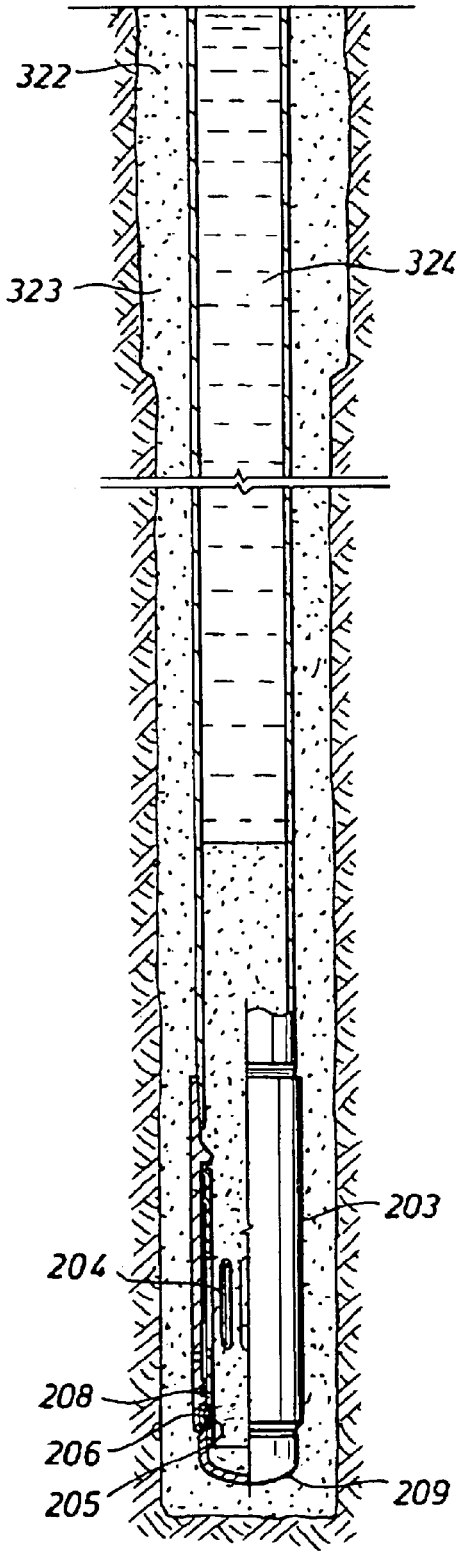
FIG. 3C shoes a float shoe according to one aspect of the invention in a closed position.

At this point, as shown in FIG. 3C, the cementing job is complete. At the time of completion, the cement slurry 323 occupies the annulus 322 from the surface down to the bottom of the borehole 321 and small portion of the bottom of the casing 210. The remainder of the casing 210 is still filled with drilling fluid 324.

The ports 204 in the float shoe 201 must now be closed to prevent the flow of fluid between the casing 210 and the annulus 322. This is accomplished by applying a downward force on the casing 210 having sufficient magnitude to shear the shear members (shown as 207 in FIGS. 2 and 3A). The bull nose 209 (if present) of the float shoe 201 contacts the bottom 312 of the borehole 301. When the downward force causes the shear members (shown as 207 in FIGS. 2 and 3A) to shear, the casing 210 is pushed downward, and the upper section 203 slides over the lower section 202 to seal the ports 204 in the lower section 202.

The upper section 203 slides down until the tapered wicker 206 engages the lock ring 205 (see FIG. 2), thereby fixing the upper section and the lower section in the closed position. In the closed position, the upper section 203 seals the ports 204 and fluid cannot flow into or out of the float shoe 201.

A method according to this aspect of the invention first includes inserting a casing having a float shoe into a borehole. The method next includes filling the annulus between the casing and the borehole wall with a cement slurry. This may be accomplished by pumping the cement slurry down the annulus, thereby forcing the drilling fluid into the casing. Once the annulus is filled with the cement slurry, the method includes closing a port in the float shoe by applying a downward force to the casing. The force should be sufficient to shear a shear member that retains an upper and a lower section in an open position and slide the sections into a closed position.

Figure 4:
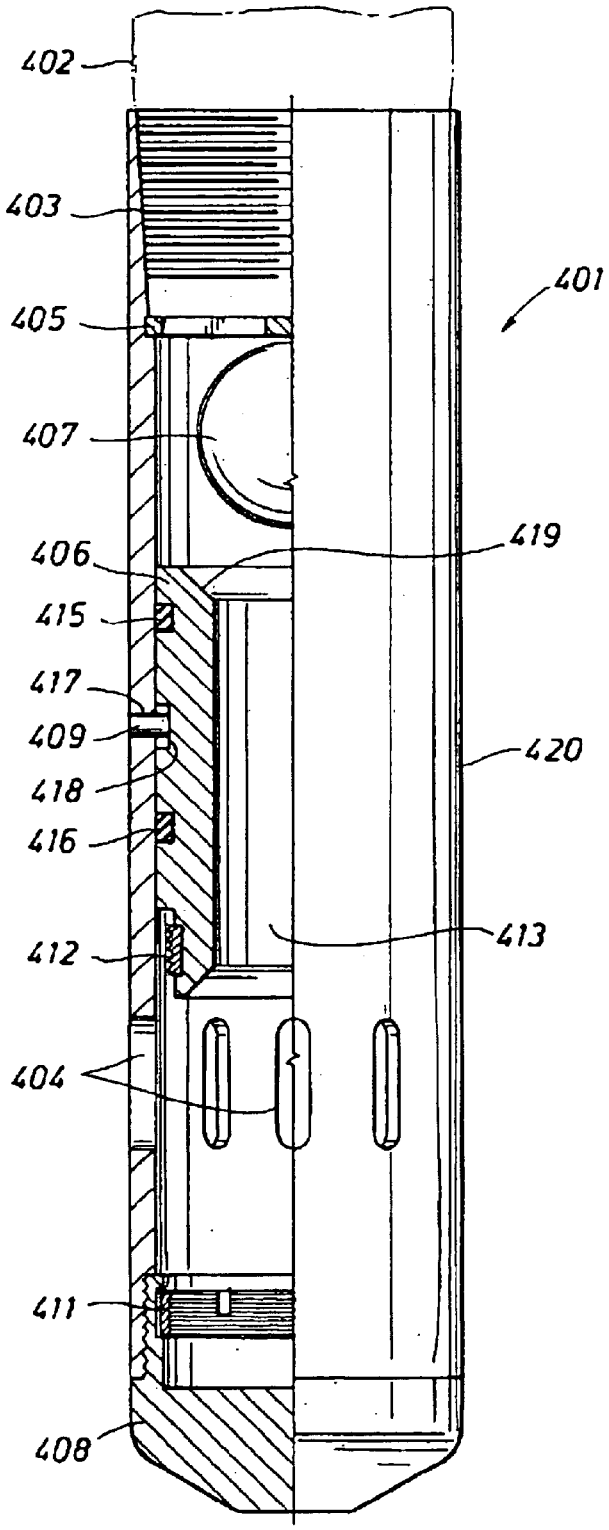
FIG. 4 shows a float shoe according to another aspect of the invention, with a cut-away cross section.

FIG. 4 shows another embodiment of a float shoe 401 according to a different aspect of the invention. A float shoe 401 according to this aspect of the invention comprises a hollow body 420. In some embodiments, the hollow body 420 is about the same diameter as a casing 402 and is connected to the bottom of the casing 402 at a casing connection 403. Hereinafter, for ease of reference, the hollow body will be referred to as a cylindrical, although it is understood that the hollow body need not be cylindrical.

The casing 402 and the float shoe 401 may be connected in any way known in the art, for example, a threaded connection. The float shoe 401 contains a number of ports 404 located near the bottom of the float shoe 401 that enable flow into and out of the float shoe 401. In some embodiments, the ports 404 comprise a plurality (e.g., eight) of longitudinal slots, as shown in FIG. 4. The bottom of the float shoe 401 may comprise a bull nose 408 that enables the float shoe 401 to be easily lowered into a borehole. Again, the bull nose may be constructed of a drillable material.

A sliding member 406 and a closing member 407 are located inside the float shoe 401. In FIGS. 4, 5A, 5B and 5C, the sliding member 406 and the closing member 407 are shown as an annular sleeve and a ball, respectively. Hereinafter, for ease of reference, they will be referred to as an annular member and a closing ball, although those having ordinary skill in the art could devise other types of sliding members and closing members, without departing from the present invention. For example, the sliding member could comprise vertical slats that cover only the ports. The closing member could be a cone or other shape that will form a seal with the sliding member. Alternatively, the closing member could be a check valve that is operatively connected to the sliding member. It is understood that the sliding member need not be an annular sleeve, and the closing member need not be a ball.

The annular sleeve 406 is positioned inside the cylindrical member 420 so that, when in an open position, it does not block flow through the ports 404. The annular sleeve 406, when moved into a closed position, is positioned so that it seals the ports 404. The annular sleeve 406 may also have a flow path 413 to enable fluids to flow past the annular sleeve 406. The annular sleeve 406 has an upper surface 419 on which the closing ball 407 may seat to seal the flow path. The seating of the closing ball 406 and the closed position will be described later and in more detail, with reference to FIG. 5C.

In some other embodiments, the annular sleeve 406 includes an upper seal 415 and a lower seal 416. The upper 415 and lower 416 seal are spaced so that they will prevent fluid from flowing in or out of the float shoe through the ports when the annular sleeve 406 is in the closed position. The closed position is described later with reference to FIG. 5C.

The annular sleeve 406 may be retained in the open position, as shown in FIG. 4, by one or more shear members 409. The shear members 409 may comprise any device that will retain the annular piston 406 in the open position, but that will shear when forced downward by the closing member 407. In some embodiments, the shear members 409 comprise shear pins that are disposed in shear pin ports 417 in the side of the cylindrical member 420 and extend into shear pin slots 418 in the piston 406. Hereinafter, although other types of shear members could be devised, the shear members will be referred to as shear pins 409.

The closing ball 407 may be a free floating member that is disposed in the float shoe 401 above the annular sleeve 406. The closing ball 407 has a larger dimension than the inner diameter of the flow path 413 in the annular sleeve 406, and the closing ball 407 comprises a surface that mates with the annular upper surface 419 of the annular sleeve 406 to seal the flow path. The closing ball 407 enables the movement of the annular sleeve 406 from the open position to the closed position, as will be described later with reference to FIG. 5C. The closing ball 407 is preferably made of a light weight but sturdy material, such as plastic or ceramic, although is may be constructed from any suitable material.

The closing ball 407 may be retained in place by the piston 406 below and by a retention member 405 above. The retention member 405, if included, retains the closing ball 407 in a position proximate to the annular upper surface 419 of the piston 406.

Figure 5A:
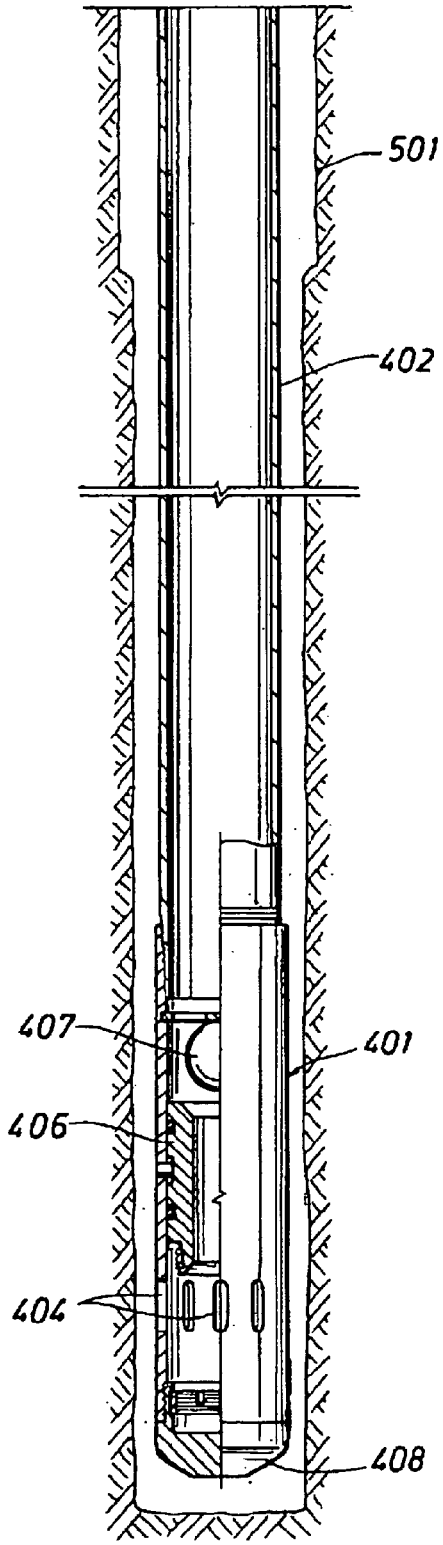
FIG. 5A shows a float shoe according to one aspect of the invention in an open position as it is being lowered into a borehole.

FIG. 5A shows a float shoe 401 in the open position as it is being run into a borehole 501. In the open position, the annular sleeve 406 is retained in position above the ports 404 by a shear pin 409. As the float shoe 401, which is connected at the lower end of a casing 402, travels into the borehole 501, some of the drilling fluid in the borehole 501 flows through the ports 404, into the float shoe 401, and up into the casing 402.

Figure 5B:
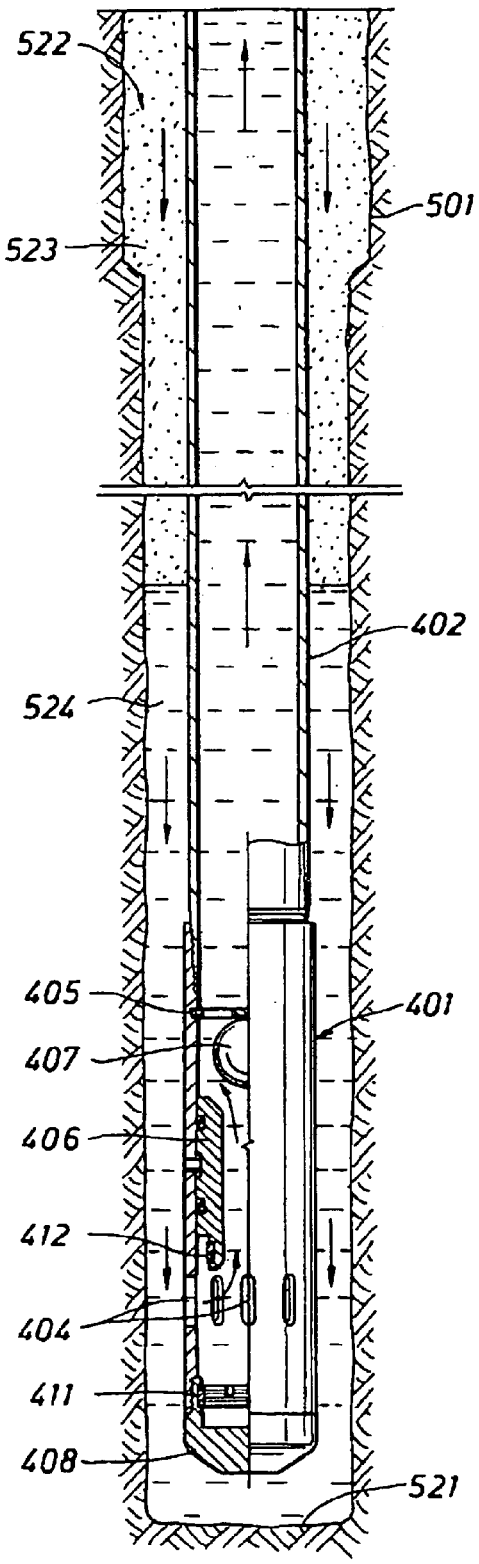
FIG. 5B shows a float shoe according to one aspect of the invention in an open position as a cement slurry is pumped into a casing.

FIG. 5B shows the casing 402 in cementing position, with the float shoe 401 connected at the bottom of the casing 402 and positioned near the bottom 521 of the borehole 501. The annular sleeve 406 is in the open position, so that fluids can flow through the ports 404 and into the float shoe 401. A cement slurry 523 is pumped into the borehole 501 and down the annulus 522 between the borehole wall 501 and the casing 402. As the cement slurry 523 is pumped into the annulus 522, the cement slurry 523 displaces the drilling fluid 524 down the annulus 522 and into the float shoe 401.

As the drilling fluid 524 travels up through the float shoe 401, it passes through the inner diameter (i.e., flow channel 413) of the annular sleeve 406 and pushes the ball 407 upward in the float shoe 401. The ball 407 is retained proximate to the annular sleeve 406 by the retention member 405. The retention member 405 may be any structure that retains the ball in its position against the force of the flow through the float shoe and still allows fluid to pass through the float shoe 401. The retention member 405 may be a screen or an arrangement of structural members that prevents the closure ball 407 from moving away from the annular sleeve 406. Those having ordinary skill in the art will be able to devise other types of retention members without departing from the scope of the invention.

During the cementing process, the cement slurry 523 displaces the drilling fluid 524 and the annulus 522 (previously filled with drilling fluid 524) becomes filled with the cement slurry 523. The cement slurry 523 will then flow into the float shoe 401 through the ports 404. When a sufficient amount of cement slurry 523 is pumped into the float shoe 401 and casing 402, the cementing process is complete. Typically, the cement slurry is pumped into the casing 402 so that between 40 and 100 feet of the casing 402 is filled with cement slurry 523.

Figure 5C:
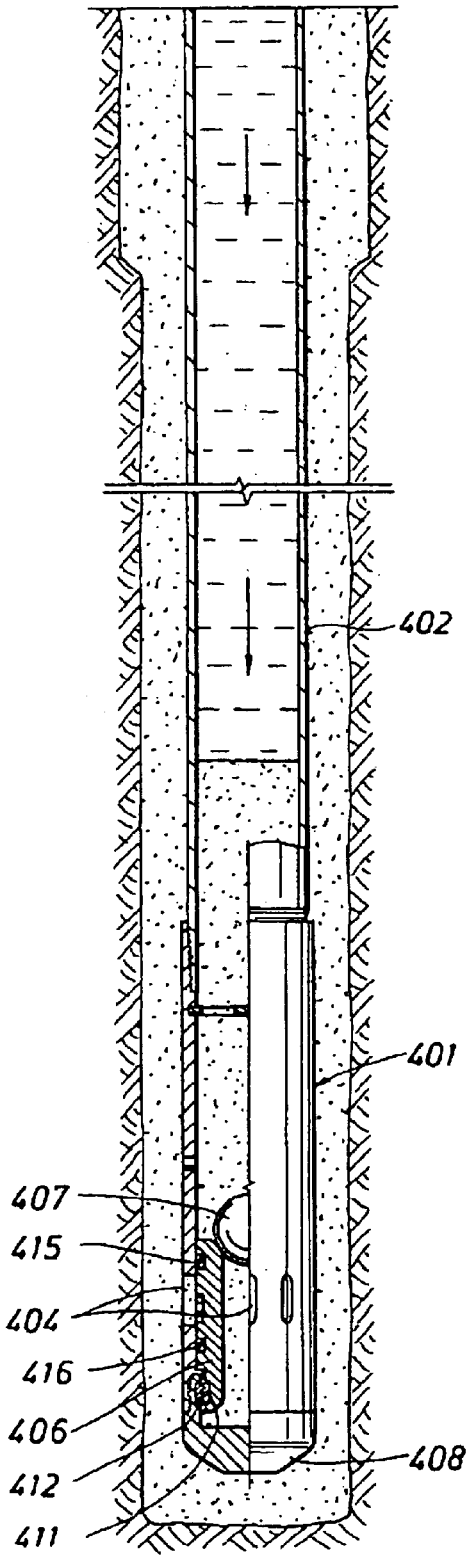
FIG. 5C shoes a float shoe according to one aspect of the invention in a closed position.

At the end of the cementing process, the piston 406 is moved into the closed position, as shown in FIG. 5C. This is accomplished by reversing the flow direction in the float shoe 401. Drilling fluid 524 is pumped into the casing 402 from the surface. As the drilling fluid 524 is pumped into the casing, the closing ball 407 moves downward and seals the flow channel 413 by seating in upper surface 419 of the annular sleeve 406. Once the closing ball 407 and annular sleeve 406 seal the flow channel 413, the pumping of drilling fluid 524 into the casing 402 will cause the pressure in the casing 402 to increase. At the designed shear pressure, the downward force of the pressure in the casing 402, applied to the closing ball 407 and the annular sleeve 406, will cause the shear pins 409 to shear, thereby allowing the piston to slide downward into the closed position.

FIG. 5C shows the piston in the closed position. The piston is moved down so that it seals the ports 404. The upper seal 415 is disposed between the piston and the inner wall of the cylindrical member 420 above the ports 404. The lower seal 416 is also disposed between the piston and the inner wall of the cylindrical member 420, but below the ports 404. The positioning of the piston 406 and the arrangement of the seals 415, 416 closes the flow path into the float shoe 401.

Referring again to FIG. 4, the annular sleeve 406 may also comprise a tapered wicker 412 at a bottom edge of the annular sleeve 406. The tapered wicker 412 is raised off of the inner wall of the cylindrical member 420 so that it can mate with the shoe locking member 411 when the annular sleeve 406 is in the closed position. When the annular sleeve 406 slides into the closed position, the shoe locking member 411, disposed on the inner wall of the cylindrical member 420 at the bottom of the float shoe 401 and facing inwards, engages the tapered wicker 412 and prevents movement of the piston. The engagement of the shoe locking member 411 and the tapered wicker 412 lock the annular sleeve 406 in the closed position.

A method according to this aspect of the invention first includes inserting a casing into a borehole. The method next includes filling an annulus between the borehole wall and the casing with a cement slurry. After filling the annulus with a cement slurry, the method includes closing ports in the float shoe by pumping drilling fluid down the annulus, thereby moving a piston to a closed position.

A float shoe according to any aspect of the invention has at least the following advantages. The float shoe does not require complicated valves and other equipment in the float shoe, thereby decreasing the complexity of the cementing process. This is particularly useful in shallow wells, where the weight of the casing is not as significant. The float shoe specifically enables reverse cementing so that the pressure across the borehole wall is reduced during cementing.

While the invention has been described with respect to a limited number of embodiments, those skilled in the art, having benefit of this disclosure, will appreciate that other embodiments can be devised that do not depart from the scope of the invention as disclosed herein. Accordingly, the scope of the invention should be limited only by the attached claims.

We claim:

1. A float shoe, comprising:

an upper section having a casing connection at an upper end thereof;

a lower section slidably coupled to the upper section, the lower section comprising a closed lower end and having at least one port disposed therein; and a plurality of shear members connected to the upper section and the lower section such that when the plurality of shear members are intact the upper section and lower section are maintained in an open position wherein the at least one port is open, and when the plurality of shear members are sheared the upper section and the lower section are able to slide into a closed position wherein the at least one port is closed;

wherein each of the plurality of shear members is disposed in a shear member port in the upper section and extends into a shear member slot in the lower section.

2. The float shoe of claim 1, further comprising a means for locking the upper section and the lower section in the closed position.

3. The float shoe of claim 1 wherein the lower section further comprises a lock ring and the upper section further comprises a tapered wicker, the lock ring and the tapered wicker arranged to retain the upper section and the lower section in the closed position.

4. The float shoe of claim 3, wherein the upper section comprises a substantially cylindrical member with the tapered wicker disposed on an inside of the upper section, and the lower section comprises a substantially cylindrical member with the lock ring disposed on an outside of the lower section, the lower section having an outer diameter substantially the same as the inner diameter of the upper member, such that that upper section forms a sleeve around the lower section.

5. The float shoe of claim 1, wherein the at least one port disposed in the lower section comprises six longitudinal ports in the lower section.

6. The float shoe of claim 1, further comprising a seal disposed radially between the upper section and the lower section, the seal preventing flow into and out of the float shoe when the lower section and the upper section are in the closed position.

7. A method for cementing a casing in a borehole, comprising the steps of:

inserting the casing having a float shoe on a lower end thereof into the borehole;

filling an annulus between a wall of the borehole and the casing with a cement slurry; and applying a downward force to the casing sufficient to shear a plurality of shear members and move an upper section and a lower section of the float shoe into a closed position;

wherein each of the plurality of shear members is disposed in a shear port in the upper section and each extends into a shear slot in the lower section.

8. The method of claim 7, wherein the upper section and the lower section are cylindrical members and the upper section forms a sleeve around the lower section.

9. The method of claim 7, wherein filling the annulus with the cement slurry comprises pumping the cement slurry down the annulus.

10. A float shoe, comprising:

hollow body having a casing connection at an upper end thereof, a closed end at a bottom end thereof, and at least one port disposed in a side thereof;

a sliding member disposed on an inside of the hollow body and positioned so that fluid can flow through the at least one port when the sliding member is in an open position and so that the at least one port is sealed when the sliding member is in a closed position, the sliding member having an annular upper surface and a fluid flow path through a center of the annular upper surface;

a closing member that allows flow upward through the fluid flow path and does not allow flow downward through the fluid flow path, the closing member positioned to transmit fluid pressure in the casing to a downward force on the sliding member; and a retention member fixed on the inside of the cylindrical member above the sliding member, the retention member adapted to retain the closing member below the retention member and to allow fluids to flow past, where in the closing member is disposed inside the hollow body and above the sliding member, the closing member having an outer diameter that is larger than an inner diameter of the annular upper surface such that the closing member forms a seal when mated with the annular upper surface of the sliding member.

11. The float shoe of claim 10, wherein the closing member is a check valve operatively connected to the sliding member.

12. The float shoe of claim 10, further comprising:

at least one shear member disposed in the hollow body and the sliding member and positioned to retain the sliding member in a fixed position with respect to the hollow body such that the at least one port is open.

13. The float shoe of claim 12, wherein the at least one shear member comprises a plurality of shear pins.

14. The float shoe of claim 13, wherein each of the plurality of shear pins is disposed in a shear pin port of the hollow body so that an inner end of each shear pin extends into a shear pin slot in the sliding member.

15. The float shoe of claim 10, wherein the hollow body comprises a cylindrical member.

16. The float shoe of claim 15, wherein the sliding member is an annular sleeve.

17. The float shoe of claim 10, further comprising:

an upper seal disposed between the inside of the hollow body and the sliding member so that the upper seal will be disposed above the at least one port when the piston is in the closed position; and a lower seal disposed between the inside of the hollow body and the sliding member so that the lower seal will be disposed below the at least one port when the sliding member is in the closed position.

18. The float shoe of claim 10, further comprising a means for locking the sliding member in the closed position.

19. The float shoe of claim 10, wherein the sliding member comprises a tapered wicker adapted to engage a shoe locking member disposed inside the hollow member, thereby retaining the sliding member in the closed position.

20. The float shoe of claim 10, wherein the at least one port comprises eight longitudinal slots spaced around a lower end of the cylindrical member.

* * * * *